US006379070B1

(12) United States Patent
Butchma

(10) Patent No.: US 6,379,070 B1
(45) Date of Patent: Apr. 30, 2002

(54) BINDER APPARATUS

(76) Inventor: Eugene T. Butchma, 89-12 216$^{th}$ St., Queens Village, NY (US) 11427

( * ) Notice: Subject to any disclaimer, the term of this patent is extended or adjusted under 35 U.S.C. 154(b) by 0 days.

(21) Appl. No.: 09/680,303

(22) Filed: Oct. 6, 2000

(51) Int. Cl.$^{7}$ ..... B42F 13/00

(52) U.S. Cl. ..... 402/73; 402/70; 281/29; 281/36; 281/37

(58) Field of Search ..... 283/15.1, 16, 29; 402/70, 73; 281/29, 31, 36, 37, 45, 21.1, 15.1

(56) References Cited

U.S. PATENT DOCUMENTS

| | | | | |
|---|---|---|---|---|
| 1,121,197 A | * | 12/1914 | McMillan | 281/16 |
| 2,317,673 A | * | 4/1943 | Craig | 281/16 |
| 2,333,523 A | * | 11/1943 | Cohun | 281/16 |
| 3,837,680 A | * | 9/1974 | Cimini | 281/16 |
| 4,139,216 A | | 2/1979 | Saint Clair | |
| 4,355,821 A | | 10/1982 | Crawford | |
| 4,571,109 A | | 2/1986 | Lapertosa | |
| 4,765,768 A | | 8/1988 | Wright | |
| 4,990,017 A | | 2/1991 | Rotherham | |
| 5,028,159 A | | 7/1991 | Amrich et al. | |
| 5,042,841 A | | 8/1991 | Friedman | |
| 5,332,327 A | | 7/1994 | Gillum | |
| 5,435,598 A | | 7/1995 | Robinson | |
| 5,494,366 A | | 2/1996 | Pell et al. | |
| 5,607,246 A | | 3/1997 | Podosek | |
| 5,620,207 A | | 4/1997 | Podosek et al. | |
| 5,651,628 A | | 7/1997 | Bankes et al. | |
| 5,882,135 A | | 3/1999 | Ko | |
| D408,851 S | | 4/1999 | To | |
| 5,951,190 A | | 9/1999 | Wilson | |
| 5,964,544 A | | 10/1999 | Ko | |
| 6,019,538 A | | 2/2000 | Whaley | |
| 6,030,140 A | | 2/2000 | Karten et al. | |
| 6,036,395 A | | 3/2000 | Dalle Rose | |
| 6,045,286 A | | 4/2000 | Tung | |

* cited by examiner

*Primary Examiner*—Willmon Fridie, Jr.
(74) *Attorney, Agent, or Firm*—Millen, White, Zelano & Branigan, P.C.

(57) ABSTRACT

A binder apparatus for holding materials and media in a binder, having a plurality of binders in opposing relation. The binders are positioned approximately parallel to and near opposing sides of a notebook constructed according to the invention and provide for a space-saving arrangement when mounted in shelves, and a stable configuration when stacked vertically in a pile.

6 Claims, 9 Drawing Sheets

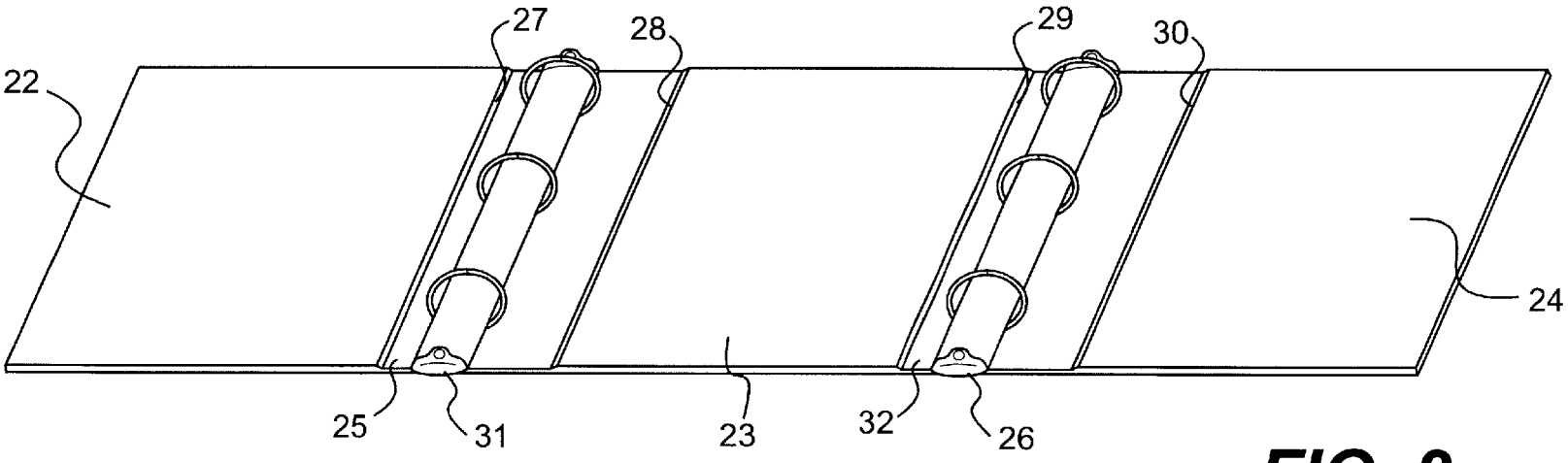
FIG. 2
FIG. 3A
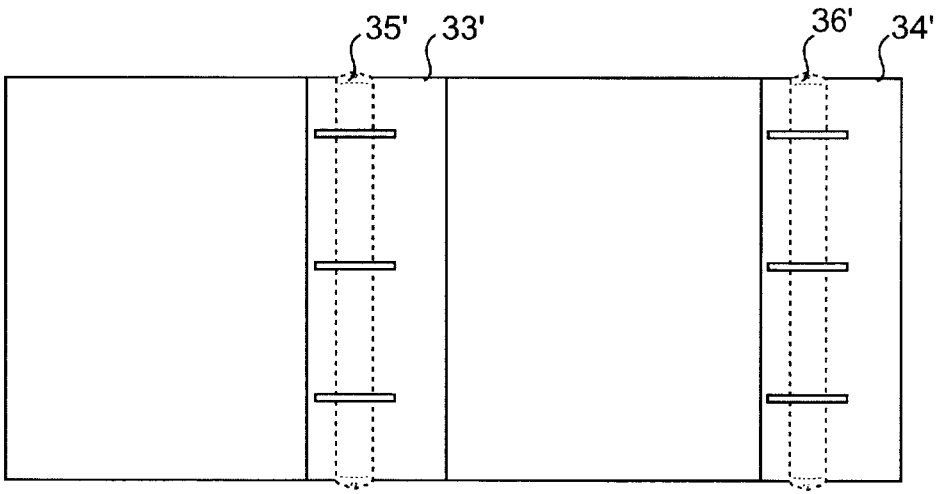

BINDER APPARATUS

BACKGROUND OF THE INVENTION

1. Field of the Invention

The present invention relates to binder systems for containing papers, documents, media, or other items in removable relation to each other. More specifically, the present invention relates to an arrangement of binders within a notebook-style cover which results in an efficient use of space, materials, and an increased storage capacity, in both the binder and the binder storage location.

2. Description of the Related Art

Binders are well known devices for keeping various types of documents together. The most commonly used version, as seen in FIG. 1, is a three ring notebook binder 10. In its most traditional embodiment, a cover 11 is provided having a first cover portion 12, a cover spine portion 13, and a second cover portion 14. The first and second cover portions 12 and 14, and the cover spine portion 13 are usually a rigid material (e.g. cardboard, plastic, or the like) and occasionally fabric covered or covered with other decorative means including padding. The first cover portion 12 and the cover spine 13 are connected by a first flexible hinge 15, and the cover spine and the second cover portion 14 are likewise connected by a second flexible hinge 16. This enables the covers 12 and 14 to flex about the hinges 15 and 16 and be closed into a traditional book-style notebook.

Retaining the contents of the notebook is a three-ring binder 17 which is formed by a spine 18 (usually metal) having a plurality of split rings 19 which are openable and closable manually or via action of lever 20. In some embodiments, the split rings 19 are biased closed via a spring mechanism (not shown).

Various embodiments of the rings and binder are known. While three is the traditional number of split rings in a binder, more, or less are also known (e.g. U.S. Pat. No. 5,042,841). Different shaped rings, e.g. a "D" shaped ring are known (e.g. U.S. Pat. No. 6,045,286; U.S. Pat. No. 5,332,327) and different designs for the rings are known (e.g. D408,851).

Rings which slide within each other are known (U.S. Pat. No. 4,765,768), as are wrap-around covers (U.S. Pat. No. 4,139,216).

A plurality of covers with living hinges are also known (e.g. U.S. Pat. No. 6,030,140) and a flexible spine portion is disclosed in U.S. Pat. No. 5,607,246. Various means for attaching the binder mechanism to the cover are known (e.g U.S. Pat. Nos. 6,019,538; 5,964,544; 5,882,135).

Mounting the ring binder on the rear cover is likewise known (U.S. Pat. No. 5,651,628; U.S. Pat. No. 5,607,246; U.S. Pat. No. 5,332,327), or about a hinge to serve as an opening-closing mechanism (U.S. Pat. No. 5,028,159); as are different types of covers, such as a thermoplastic cover with grooves delineating a spine portion (U.S. Pat. No. 5,620,207). A notebook which can act as a display stand is shown in U.S. Pat. No. 5,332,327 and in U.S. Pat. No. 4,335,821.

An expandable, double ring binder is disclosed in U.S. Pat. No. 4,990,017, where the rings are mounted on the same cover spine portion.

While each of these patents illustrates a unique method for adapting a binder-type device to a particular use or convenience, none addresses the constant dilemma of preventing the waste of scarce shelf space and creating a stable, uniform binder apparatus which is attractive and functional. A solution to this problem is needed.

SUMMARY OF THE INVENTION

An object of the present invention is to provide a binder arrangement which is attractive and functional.

It is a further object of the present invention to provide a binder arrangement which results in the maximum efficiency in space utilization for the binder.

It is yet another object of the present invention to provide a binder arrangement with a plurality of binders in opposing relation to each other.

It is an additional object of the present invention to provide a binder which, when closed, presents an essentially parallel cover arrangement over any level of fill.

It is yet an additional object of the present invention to provide a binder arrangement, which, when placed in relation with other such binders, efficiently utilizes the space on a shelf or other storage area.

It is a further object of the present invention to provide a binder arrangement which is stackable in the vertical direction with other such binders in a stable and essentially upright manner.

It is yet an additional object of the present invention to provide for the storage of materials in a binder while providing a savings of materials while constructing the binder.

Other objects, features, and characteristics of the present invention as well as the methods of use of related elements will become more apparent upon consideration of the following description and the appended claims with reference to the accompanying drawings, wherein like reference numbers designate corresponding elements in the various figures.

BRIEF DESCRIPTION OF THE DRAWINGS

FIG. 2 is a perspective view of a preferred embodiment of the present invention.

FIGS. 3 and 3A are perspective views of other preferred embodiments of the present invention.

DETAILED DESCRIPTION OF PREFERRED EMBODIMENTS

Figure 1A:
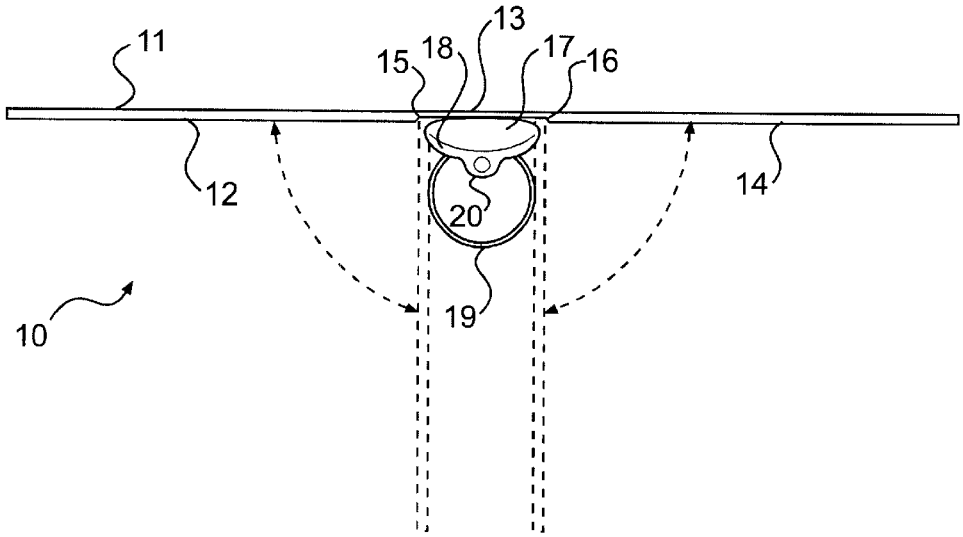
FIG. 1A (PRIOR ART)
FIG. 1A is a top elevation view of the binder shown in FIG. 1.
Figure 1:
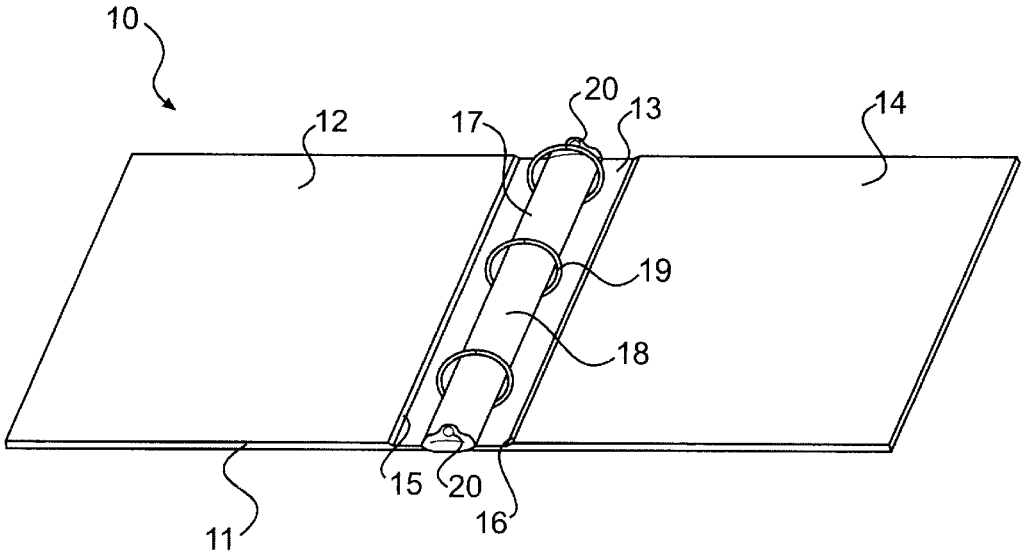
FIG. 1 (PRIOR ART)
FIG. 1 is a perspective view of the known prior art three-ring binder.

As shown in FIG. 2, a preferred embodiment of a device according to the instant invention is designated generally by the reference numeral 21. The preferred embodiment includes three cover panels (first cover panel 22, central cover panel 23, and second cover panel 24) and two spine panels (25, 26), connected by four flexible hinges (27, 28, 29, 30). Each panel 22–26, or cover, has a top edge or side, a bottom edge or side, a first side edge, and a second side edge.

Affixed to each spine panel (25 and 26) is a binder device (31, 32) for releasably engaging articles to be held within the binder. Such articles may be paper (e.g. 8.5×11 inch paper punched with appropriate holes), or other articles which are desired to be retained in sequential alignment, such as photograph album pages, compact disc carrier pages, trial exhibits, etc.

In its presently preferred embodiment the binder 21 comprises a standard three ring binder with split-rings which are openable and closable. In the embodiment of FIG. 2, the ring binders 31 and 32 are centrally disposed on each of the spine panels 25 and 26 and the central cover panel 23 is slightly wider (in the direction between the spines) than the documents, papers, or other media to be contained within the binder 21. Thus, the various papers or other items contained in the binder apparatus 21 may lie against each other in a space-saving relationship.

Figure 3B:
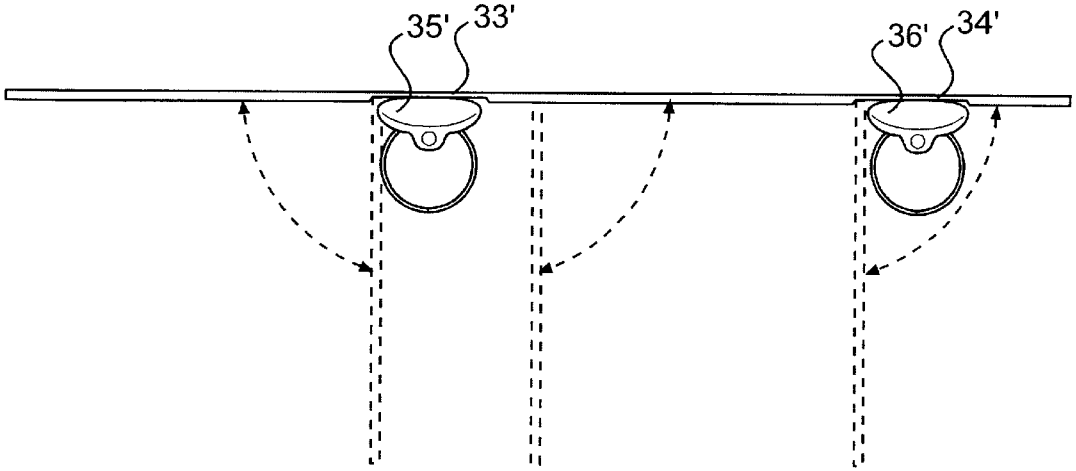
FIG. 3B is a top elevation view of the binder shown in FIG. 3A.
Figure 3:
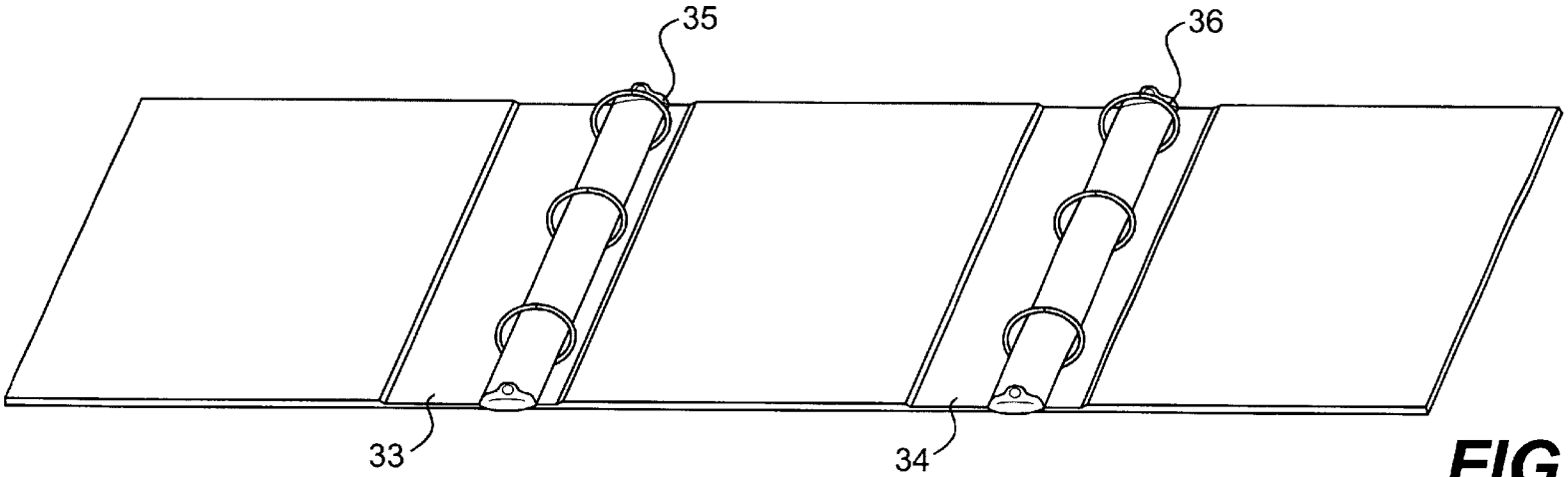

In a particularly preferred embodiment, the binder mechanisms are mounted to one side of the spine panels, which are oversized as regards the binder mechanism. With reference to FIGS. 3 and 3A, it may be seen that spine panel 33 and 33' and spine panel 34 and 34' have the binder mechanisms 35 and 35' and 36 and 36' offset. Thus, when the binder is completely full and closed on both sides, the space-saving arrangement is clearly visible as seen in FIGS. 3B and 4 (corresponding to 3A and 2 respectively).

Figure 4:
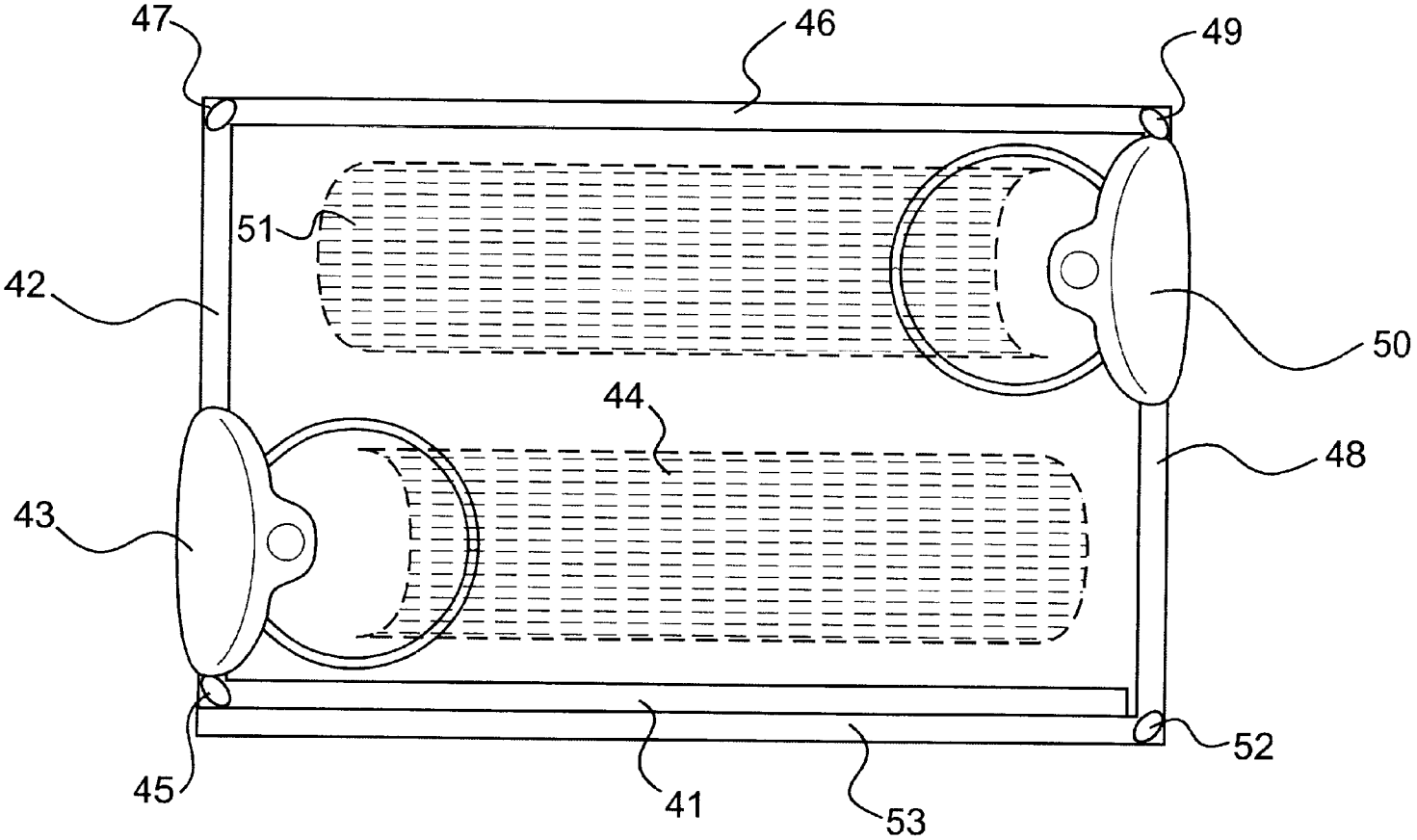
FIG. 4 is a top elevation view of the embodiment of FIG. 3 illustrating the binder when filled with loose-leaf paper.

In FIG. 4, first cover panel 41 acts as an external cover panel, first spine panel 42 has affixed in a lower position first binder mechanism 43 which is shown containing loose-leaf paper 44. First cover panel 41 is hingeably connected to first spine panel 42 via a flexible hinge member 45, such as a flexible plastic hinge, or a cloth binding element. First spine panel 42 is likewise hingeably connected to central cover panel 46 by a flexible hinge member 47. Central cover panel 46 is hingeably connected to second spine member 48 by flexible hinge member 49. Second spine member 48 has affixed to it in an upper position second binder mechanism 50, shown with loose leaf paper 51. Second spine member 48 is shown in this embodiment hingeably connected to second cover panel 53 by flexible hinge element 52. As illustrated in FIG. 3A, a second cover panel 53 in FIG. 4 is not absolutely necessary.

Figure 5:
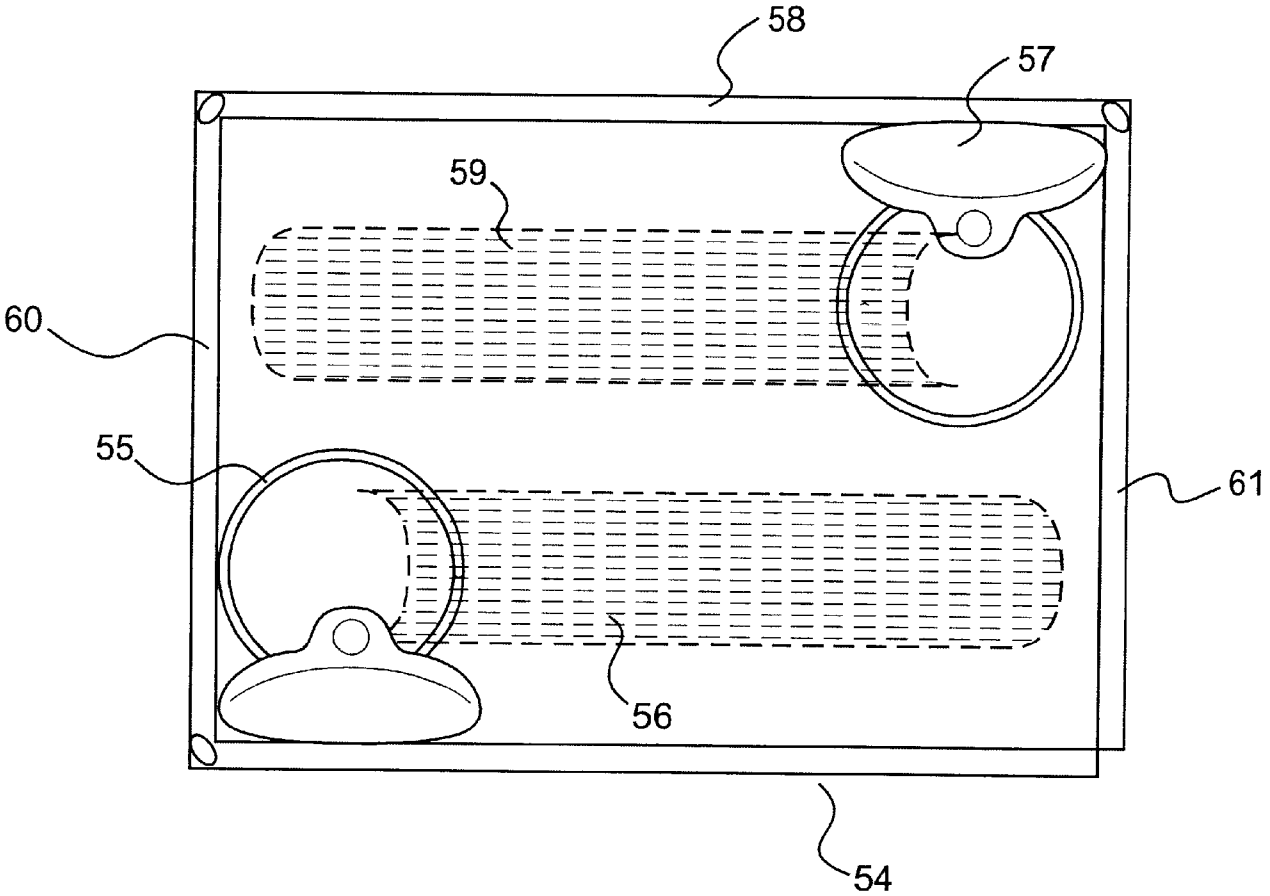
FIG. 5 is a top elevation view of an alternate embodiment illustrating a D-Ring style binder with the binder mechanisms mounted upon the cover portions.

In an alternative embodiment, the rings may be mounted upon the various cover panels using specially shaped rings. Turning to FIG. 5, such an arrangement is contemplated. First D-Ring binder mechanism 55 is mounted upon first cover panel 54. The first D-Ring binder 55 contains loose-leaf style paper 56, and is located in a lower position when considering the binder 55 overall in the orientation displayed in FIG. 5. A second D-ring binder 57 is mounted upon central cover panel 58 and contains loose-leaf paper 59. The outer cover is constructed in a conventional manner, with the first cover panel 54 being hingeably connected to first spine panel 60, and first spine panel 60 being hingeably connected to central cover panel 58, and central cover panel 58 being optionally connected to second spine panel 61.

The materials for use in a binder arrangement according to the present invention may be selected from various conventionally used materials. If a hard binder is desired, suitable materials include a rigid board covered with a fabric, or a heavy gauge cardboard, plastics, or other suitable material with sufficient rigidity. A decorative cover, e.g. a layer of polypropylene imprinted with a design or a vinyl cover may also be used. Flexible covers, e.g. lightweight plastic such as vinyl, polyvinyl chloride or polypropylene may be used.

The binder mechanism as used in the present invention may be any of various conventional mechanisms. A traditional three-ring snap binder may be used, or binders which slide, screw, or lever open or closed may be used. More or fewer rings may be used, but it is preferred that at least two rings are used, although in certain applications a single holding device may be used. Clamps, clips, and other mechanisms for holding materials within the binder may be used.

The physical arrangement of the binder in the cover gives the inventive binder significantly improved properties over traditional binders, which, when closed, waste a significant amount of shelf space by virtue of excess spine space. In an embodiment of the invention, opposing binder rings help more efficiently utilize the space both within the binder space (from spine-to-spine) and longitudinally along the shelf space within which the binder may rest in association with other binders.

Figure 6:
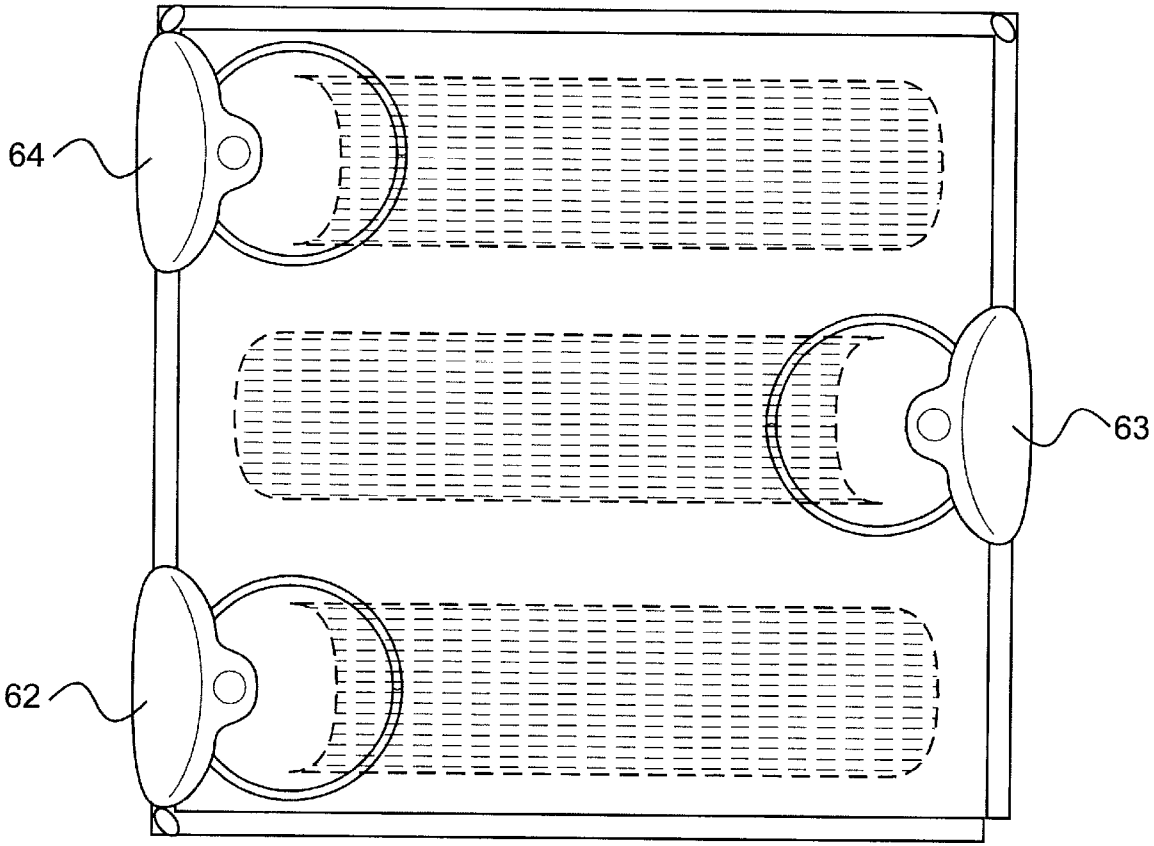
FIG. 6 is a top elevation view of a still further embodiment of the present invention.

A particularly preferred binder which saves space and yields a very flexible format for presentation and organization is seen in FIG. 6. Three different binder mechanisms 62, 63, and 64 are mounted in opposed configuration to provide an attractive and functional binder apparatus. The relative size of the rings may be adjusted to provide for one large binder in the middle (e.g. 63, while the other two binders may be smaller (62, 64) to result in the same end result—an essentially parallel pair of outer covers.

Figure 7:
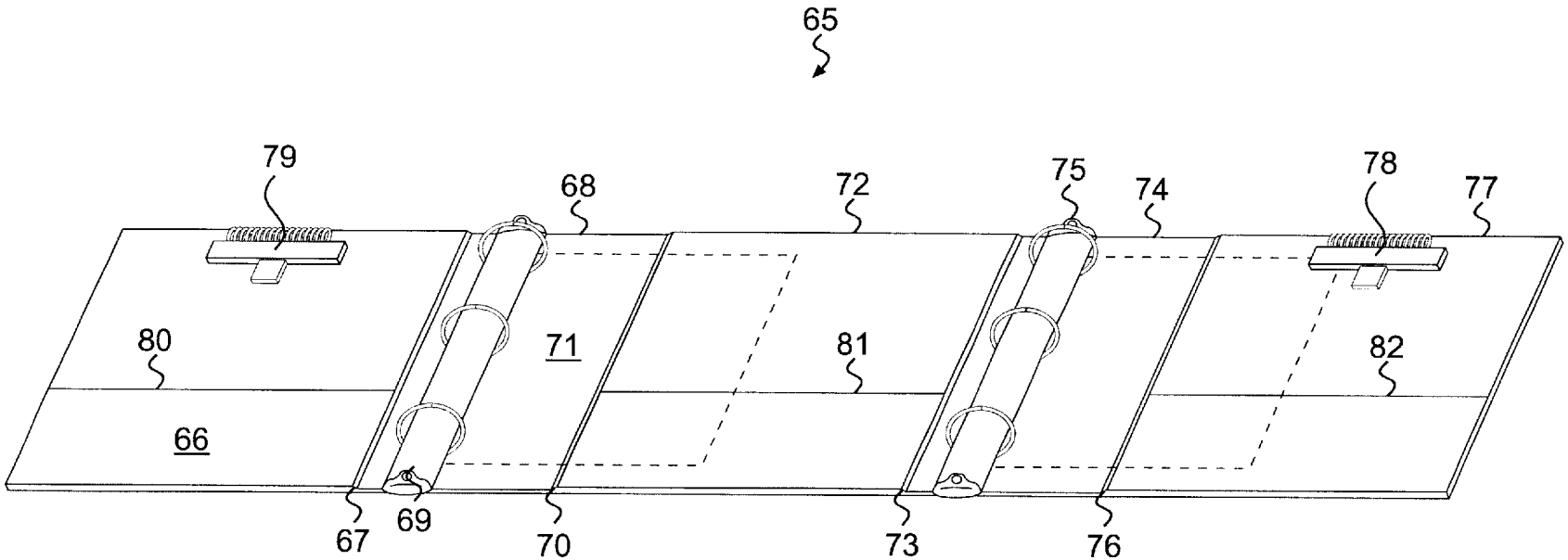
FIG. 7 is a perspective view of another further embodiment of the present invention.

In FIG. 7, another alternate embodiment is seen. Notebook 65 is seen with a first cover portion 66 hingeably connected by a first hinge 67 to a first spine portion 68. Attached to the first spine portion 68 is a first binder 69. The first binder 69 is approximately parallel to the first hinge 67 and positioned closer to (proximate or proximal to) the first hinge 67 than the second hinge 70. This leaves an unoccupied space 71 on the first spine portion 6. Shown in phantom in this region are media (e.g. loose leaf paper or other media which could be held in first binder 69.

Second cover portion 72 is hingeably connected by third hinge 70 to first spine portion 68. Second cover portion 72 is, on an opposing side from second hinge 70, hingeably connected by third hinge 73 to second spine portion 74. Affixed to second spine portion 74 is second binder 75, located closer to third hinge 73 than to fourth hinge 76, which hingeably connects to third cover portion 77. Affixed to both third cover portion 77 and first cover portion 66 are additional fasteners 78 and 79, respectively. These fasteners 78–79 may be spring-loaded clips, adhesive fasteners, or any other suitable fasteners known in the art.

When the embodiment in FIG. 7 is in the open position, it provides a readily accessible multiple binder notebook with access to 4 different media displays, for example, a scratch pad may be affixed under additional fastener 79 for taking notes during a trial or deposition, exhibits from one side may be fastened within binder 69, exhibits from another side be fastened within binder 75, and additional notes or other documents be held in fastener 78. Pockets 81, 82, and 83 may be provided my manner known in the art, e.g. heat welding a vinyl pocket in place or by other means of affixation.

Figure 8:
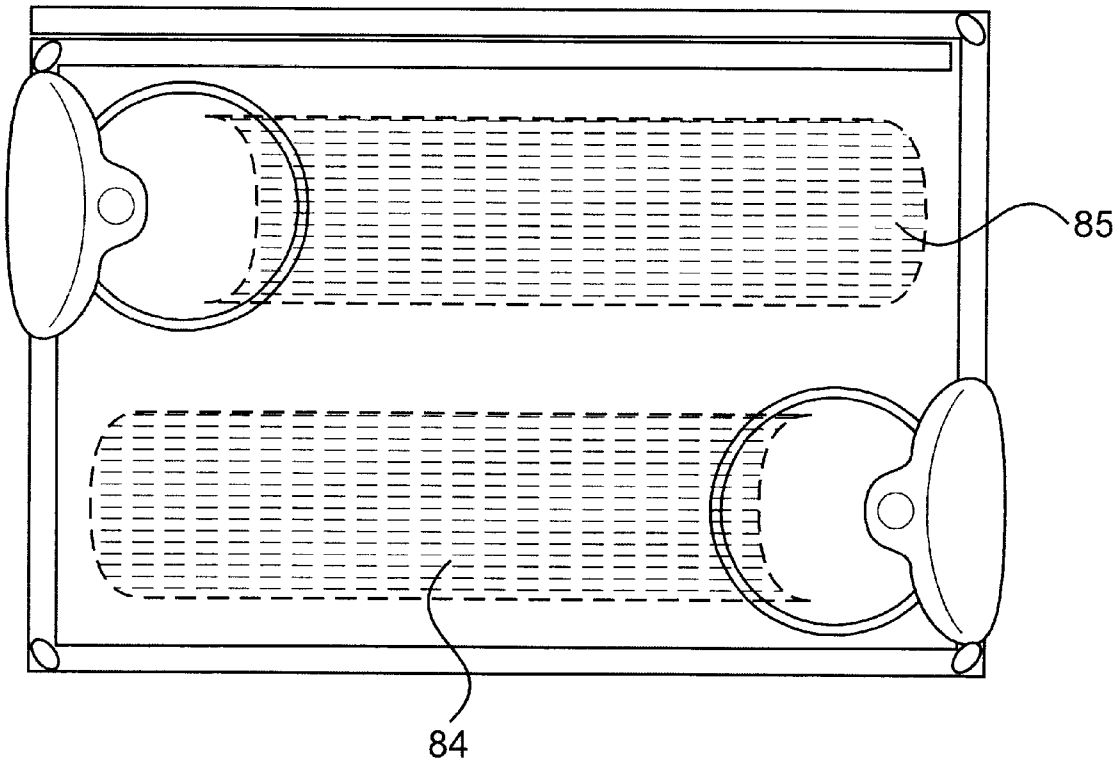
FIG. 8 is a top elevation view of the binder shown in FIG. 7.
Figure 9B:
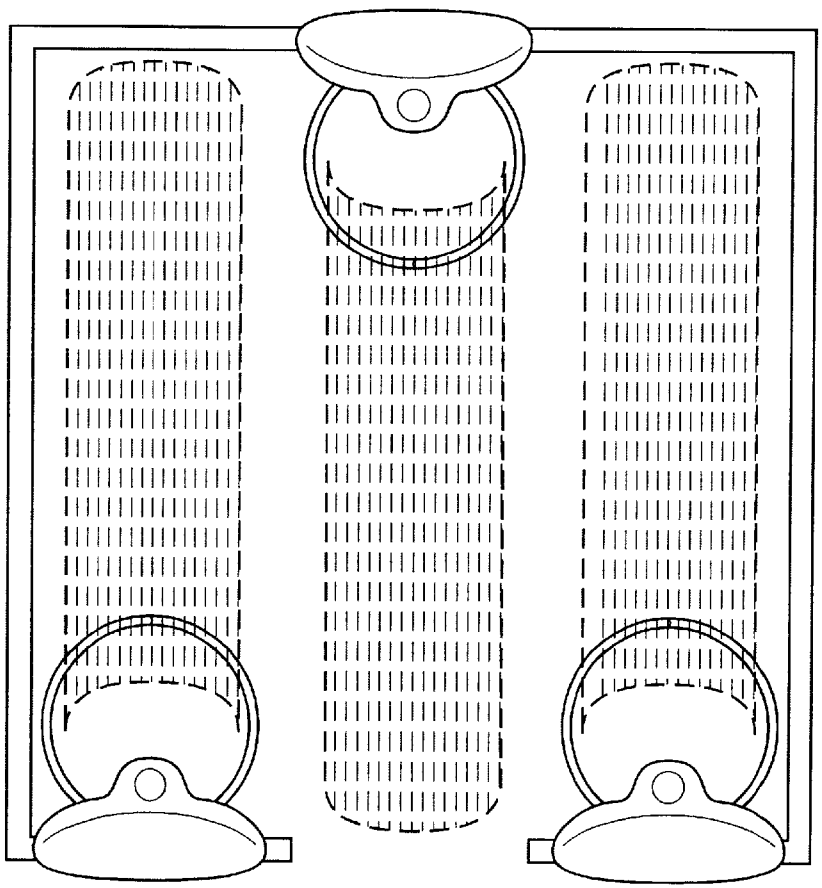
FIGS. 9A and 9B are top elevation views of other further embodiments of the present invention.
Figure 9A:
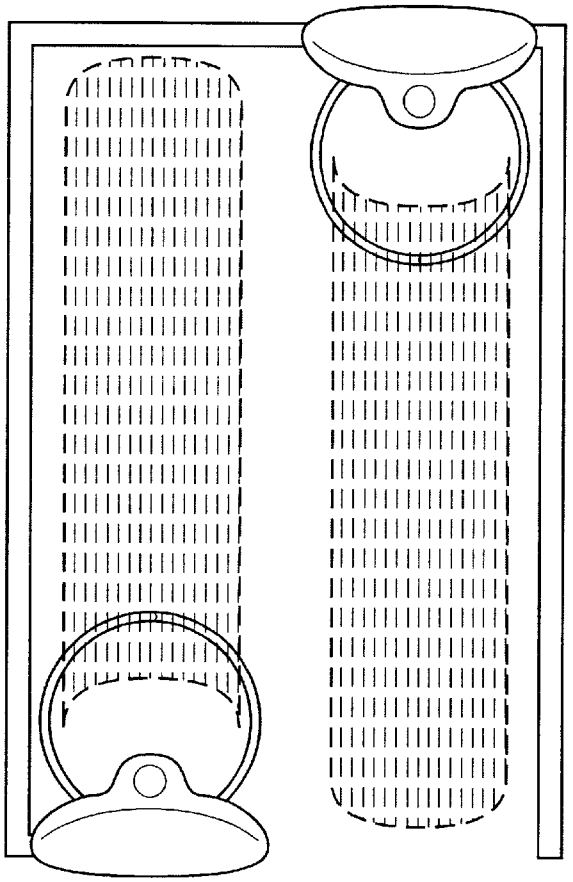

When the embodiment of FIG. 7 is in the closed position, the loose leaf media may be folded on top of each other, and the covers sequentially closed, to result in the tidy, organized, and secure binder seen in FIG. 8. As may be seen, the loose leaf media 84 and 85 are aligned in contiguous planes which provide for an effective and space saving storage of material. The alignment of media in contiguous planes is also evident in embodiments displayed in earlier figures. Still further embodiments are illustrated in FIGS. 9A and 9B.

While the invention has been described in connection with preferred embodiments, it should be understood readily that the present invention is not limited to the disclosed embodiment. Rather, the present invention is intended to cover various equivalent arrangements and is only limited by the claims which follow. One of skill in the art, having regard for this disclosure, can now readily envision many variations without departing from the scope of the claims which follow.

The entire disclosures of all patents and publications, cited above, are hereby incorporated by reference.

What is claimed is:

1. A binder apparatus comprising:

a first cover portion having a top edge, a bottom edge, a first side edge, and a second side edge;

a first spine portion having a top edge, a bottom edge, a first side edge and a second side edge, said first side edge and a width therebetween being hingeably connected to a side edge of said first cover portion, a second cover portion having a top edge, a bottom edge, a first side edge, and as second side edge, the first side edge of said second cover portion being hingeably connected to the second edge of said first spine portion, said first cover portion, said first spine portion, and said second cover portion defining a notebook with a first side, a second side, a top side, and a bottom side, a second spine portion, said second spine portion having a top edge, a bottom edge, a first side edge, and a second side edge and a width therebetween, and being hingeably connected to the second side portion of said second cover portion by its first side edge; and a first binder mounted on the first spine portion and a second binder mounted on the second spine portion, wherein each binder has width, and the width of each binder is less than width of the respective spine portions onto which the binders are mounted.

2. A binder apparatus as claimed in claim 1, wherein the binders are three-ring binders.

3. A binder apparatus as claimed in claim 1, further comprising a third cover portion hingeably connected to said second side of said second spine portion.

4. A binder apparatus as claimed in claim 1, wherein the cover and spine portions are rigid.

5. A binder apparatus as claimed in claim 1, wherein the cover and spine portions are flexible.

6. A binder apparatus as claimed in claim 1, wherein the cover and spine portions comprise plastic.

* * * * *

US006379070C1

(12) EX PARTE REEXAMINATION CERTIFICATE (7272nd)

United States Patent
Butchma

(10) Number: US 6,379,070 C1
(45) Certificate Issued: Dec. 29, 2009

(54) BINDER APPARATUS

(76) Inventor: Eugene T. Butchma, 89-12 216$^{th}$ St., Queens Village, NY (US) 11427

Reexamination Request:
No. 90/010,384, Jan. 12, 2009

Reexamination Certificate for:

| | |
|---|---|
| Patent No.: | **6,379,070** |
| Issued: | **Apr. 30, 2002** |
| Appl. No.: | **09/680,303** |
| Filed: | **Oct. 6, 2000** |

(51) Int. Cl.
*B42F 13/00* (2006.01)

(52) U.S. Cl. ..... 402/73; 402/70; 281/29; 281/36; 281/37

(58) Field of Classification Search ..... None
See application file for complete search history.

(56) References Cited

U.S. PATENT DOCUMENTS

| | | | |
|---|---|---|---|
| 1,121,197 | A | 12/1914 | McMillan |
| 1,913,818 | A | 6/1933 | Petrick |
| 3,936,202 | A | 2/1976 | Brajituli |
| 4,515,493 | A | 5/1985 | Radovich |
| 5,174,674 | A | 12/1992 | Norwood |
| 5,215,398 | A | 6/1993 | White et al. |

*Primary Examiner*—Robert M. Fetsuga

(57) ABSTRACT

A binder apparatus for holding materials and media in a binder, having a plurality of binders in opposing relation. The binders are positioned approximately parallel to and near opposing sides of a notebook constructed according to the invention and provide for a space-saving arrangement when mounted in shelves, and a stable configuration when stacked vertically in a pile.

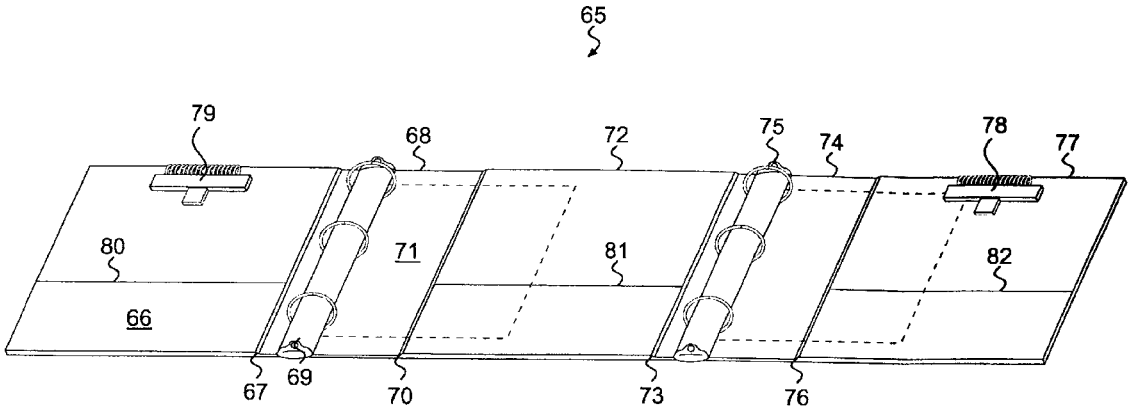

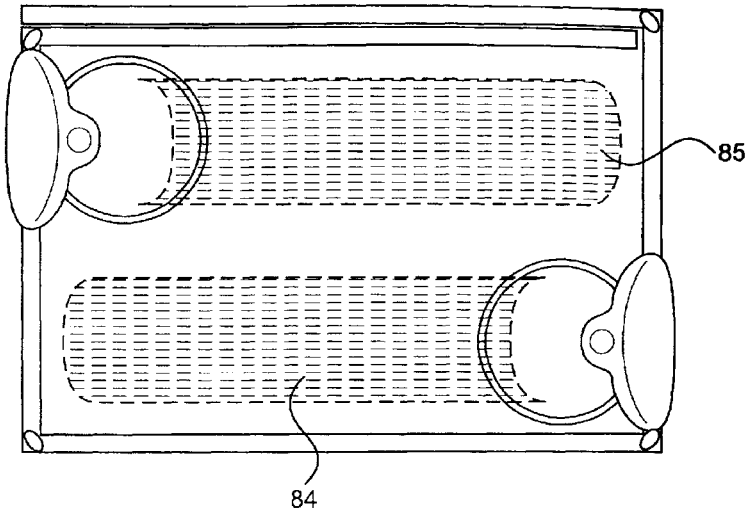

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–6 are cancelled.

* * * * *